US005497700A

United States Patent [19]

Herb

[11] Patent Number: 5,497,700

[45] Date of Patent: Mar. 12, 1996

[54] ROTOGRAVURE INKING SYSTEM

[75] Inventor: Rudolf Herb, Bobenheim/Roxheim, Germany

[73] Assignee: Albert-Frankenthal Aktiengesellschaft, Frankenthal, Germany

[21] Appl. No.: 347,121

[22] Filed: Nov. 23, 1994

[30] Foreign Application Priority Data

Nov. 25, 1993 [DE] Germany ..... 43 40 128.7

[51] Int. Cl.[6] ..... B41F 9/10; B41F 31/07

[52] U.S. Cl. ..... 101/153; 101/157

[58] Field of Search ..... 101/157, 169, 101/363, 364, 350, 366, 152, 153, 167, 207–210, 425

[56] References Cited

U.S. PATENT DOCUMENTS

| | | | |
|---|---|---|---|
| 2,404,689 | 7/1946 | Carlsen et al. | 101/169 |
| 4,426,412 | 1/1984 | Gebert et al. | 101/207 X |
| 5,005,476 | 4/1991 | Kobler | 101/363 |
| 5,012,736 | 5/1991 | Van Kanegan | 101/207 |
| 5,103,723 | 4/1992 | Maier . | |

FOREIGN PATENT DOCUMENTS

| | | |
|---|---|---|
| 3025291 | 1/1982 | Germany . |
| 3151005 | 7/1983 | Germany . |
| 4030377 | 4/1992 | Germany . |
| 532460 | 1/1941 | United Kingdom . |

*Primary Examiner*—J. Reed Fisher
*Attorney, Agent, or Firm*—Jones, Tullar & Cooper

[57] ABSTRACT

A rotogravure inking system uses an ink trough to apply ink to a printing cylinder that dips into ink in the ink trough. The ink trough has a length less than the length of the printing cylinder. Projecting end portions of the printing cylinder are not supplied with ink from the ink trough. Thus end faces of the printing cylinder will not receive any ink and will not throw off the ink thereby eliminating ink spattering and the associated spatter protection shields.

4 Claims, 2 Drawing Sheets

ROTOGRAVURE INKING SYSTEM

FIELD OF THE INVENTION

The present invention is directed generally to a rotogravure inking system. More particularly, the present invention is directed to an inking system for a rotogravure rotary printing press. Most specifically, the present invention is directed to a rotogravure inking system for a rotary printing press and including an ink trough, a printing cylinder and an inking roller. The inking roller is situated in the ink trough and contacts the face of the printing cylinder. The length of the ink trough is less than the length of the printing cylinder. End faces of the ink trough have recesses whose radii are the same as the radius of the printing cylinder. A doctor blade device carries a doctor blade that acts on the jacket surface of the printing cylinder. The rotogravure inking system reduces ink spattering and dispenses with the need for printing press side shields.

DESCRIPTION OF THE PRIOR ART

In the field of rotogravure printing, it is generally known to apply printing ink to the surface of a printing cylinder and to then contact a paper web or the like to be printed with the printing cylinder. The ink is applied to the surface or jacket of the printing cylinder by dipping the cylinder face in an ink trough which contains the gravure printing ink. An ink roller is typically situated in the ink trough and contacts the surface of the printing cylinder to effect an even distribution of the printing ink on the surface of the printing cylinder. Any excess printing ink is removed from the surface of the printing cylinder by utilizing a doctor blade device that carries a doctor blade which is engageable with the face of the printing cylinder. The removed excess ink is collected in an ink tub which underlies the ink trough and is then recirculated back into the ink trough together with additional fresh ink. A suitable ink recirculator device is provided to effect this recirculation of the ink. An example of a rotogravure printing cylinder arrangement of this general type may be seen at pages 32 and 33 of a brochure entitled "Tiefdruckrotationsmachinen" [Rotogravure Printing Presses] of KBA Albert-Frankenthal AG. This brochure was published in 1990.

As the printing cylinder in these prior art rotogravure devices immerses itself in the ink trough, it is apt to get ink on the end faces of the printing cylinder. Any such ink will not be removed from the printing cylinder by the doctor blade device and will remain on the end faces of the printing cylinder. As the printing cylinder rotates during normal press operation, this excess ink collected on the end faces of the printing cylinder will be thrown off by centrifugal force and will splatter the sides of the press frames and may also contact the printed web. Such ink spattering is clearly undesirable and has given rise to the use of various shields and covers to restrict the random throwing of ink droplets. These shields obstruct access to the press and are an obstruction.

It will be seen that a need exists for an inking system for a rotogravure printing press which avoids the problems of the prior art devices. The rotogravure inking system in accordance with the present invention provides such a device and is a substantial improvement over the prior art.

SUMMARY OF THE INVENTION

It is an object of the present invention to provide a rotogravure inking system.

Another object of the present invention is to provide an inking system for a rotogravure rotary inking press.

A further object of the present invention is to provide a rotogravure inking system including an ink trough with an inking roller.

Yet another object of the present invention is to provide a rotogravure inking system which prevents printing ink from reaching end faces of the printing cylinder.

Still a further object of the present invention is to provide a rotogravure inking system which eliminates ink spattering.

Even yet another object of the present invention is to provide a rotogravure inking system including spray nozzles for cleaning end portions of the printing cylinder.

As will be discussed in greater detail in the description of the preferred embodiment which is presented subsequently, the rotogravure inking system in accordance with the present invention utilizes a gravure printing cylinder, in cooperation with a pressing roller, to print on a sheet or web of material. Ink is applied to the face or jacket surface of the printing cylinder by dipping the cylinder in an ink trough which is supported beneath the printing cylinder. An inking roller is provided in the ink trough and contacts the surface or jacket face of the printing cylinder and insures that gravure ink from the ink trough is spread evenly on the face of the printing cylinder. In accordance with the present invention, the clear length of the ink trough is less than the axial length of the printing cylinder. The ink trough is provided with end plates or walls which have cut-outs or recesses in their upper edges. The radii of curvature of these recesses is generally the same as the radius of the printing cylinder. Small gaps are thus formed between the upper edges of the cut-outs and the surface of the printing cylinder. The printing cylinder extends longitudinally or axially beyond the end faces of the ink trough. This insures that the end faces of the printing cylinder will not dip into the ink trough and will not be contacted by the printing ink.

A doctor blade device, which includes a doctor blade, is positioned adjacent the printing cylinder. The doctor blade removes excess ink from the surface of the printing cylinder and returns it to an ink tub which underlies the ink trough. Suitable spray nozzles are carried at the ends of the doctor blade device and are usable to apply an ink solvent spray or another type of spray to the ends of the printing cylinder which extend beyond the end faces of the ink trough.

The rotogravure inking system in accordance with the present invention eliminates the chronic ink spattering problems which have characterized the prior art devices. Since the ends of the printing cylinder extend beyond the end walls of the ink trough, printing ink cannot get onto the end faces of the printing cylinder. This means that there will be no ink to be thrown off the printing cylinder end faces. Accordingly, there is no need for the protective spatter shields which were previously required. Thus these spatter shields, which have been in the past attached to the printing press side frames, can be disposed of.

The rotogravure inking system in accordance with the present invention overcomes the limitations of the prior art devices. It provides a significant advance in the art.

BRIEF DESCRIPTION OF THE DRAWINGS

While the novel features of the rotogravure inking system in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
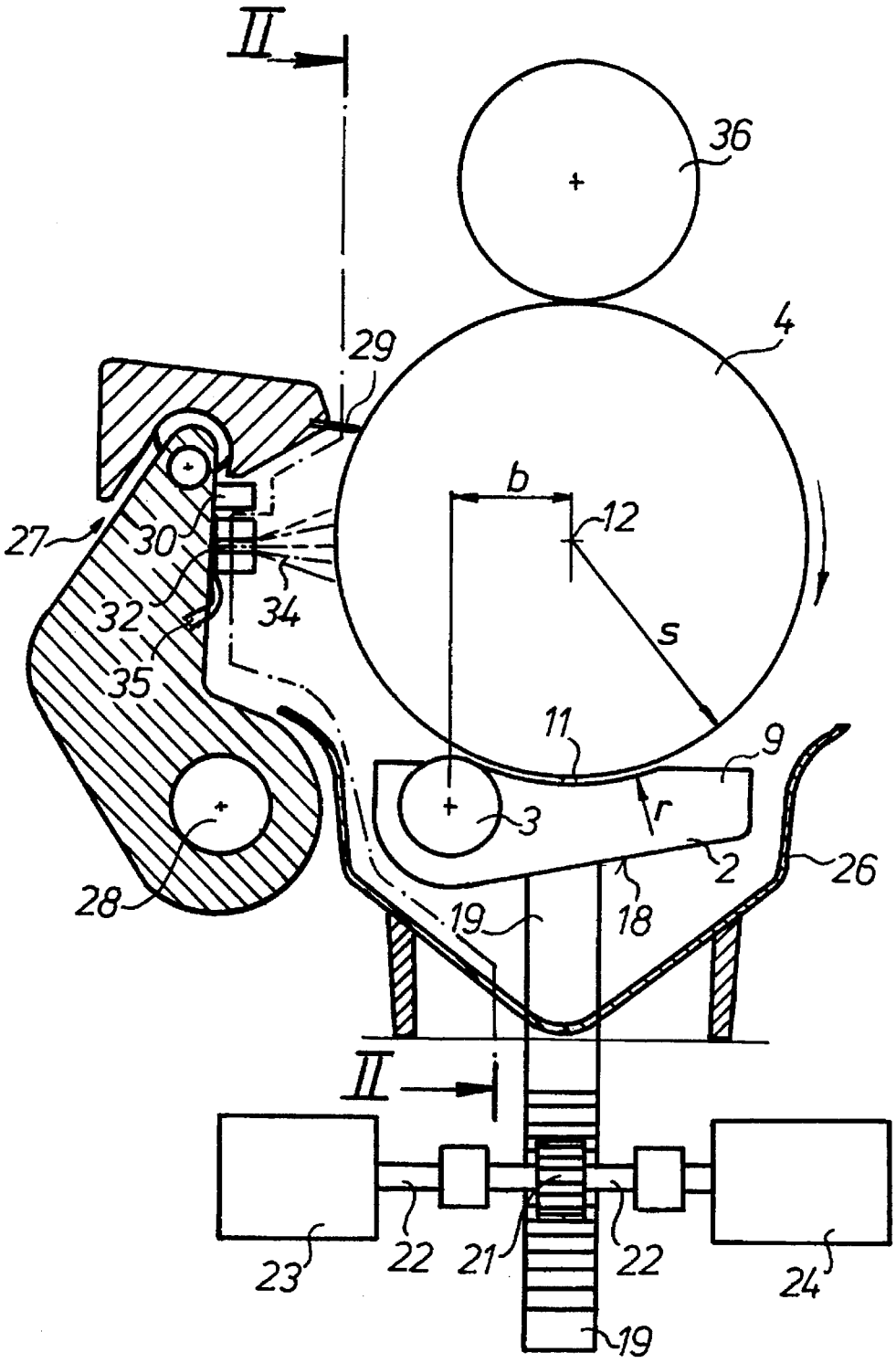
FIG. 1 is a schematic side elevation view, partly in section, and showing a preferred embodiment of a rotogravure inking system in accordance with the present invention.
Figure 2:
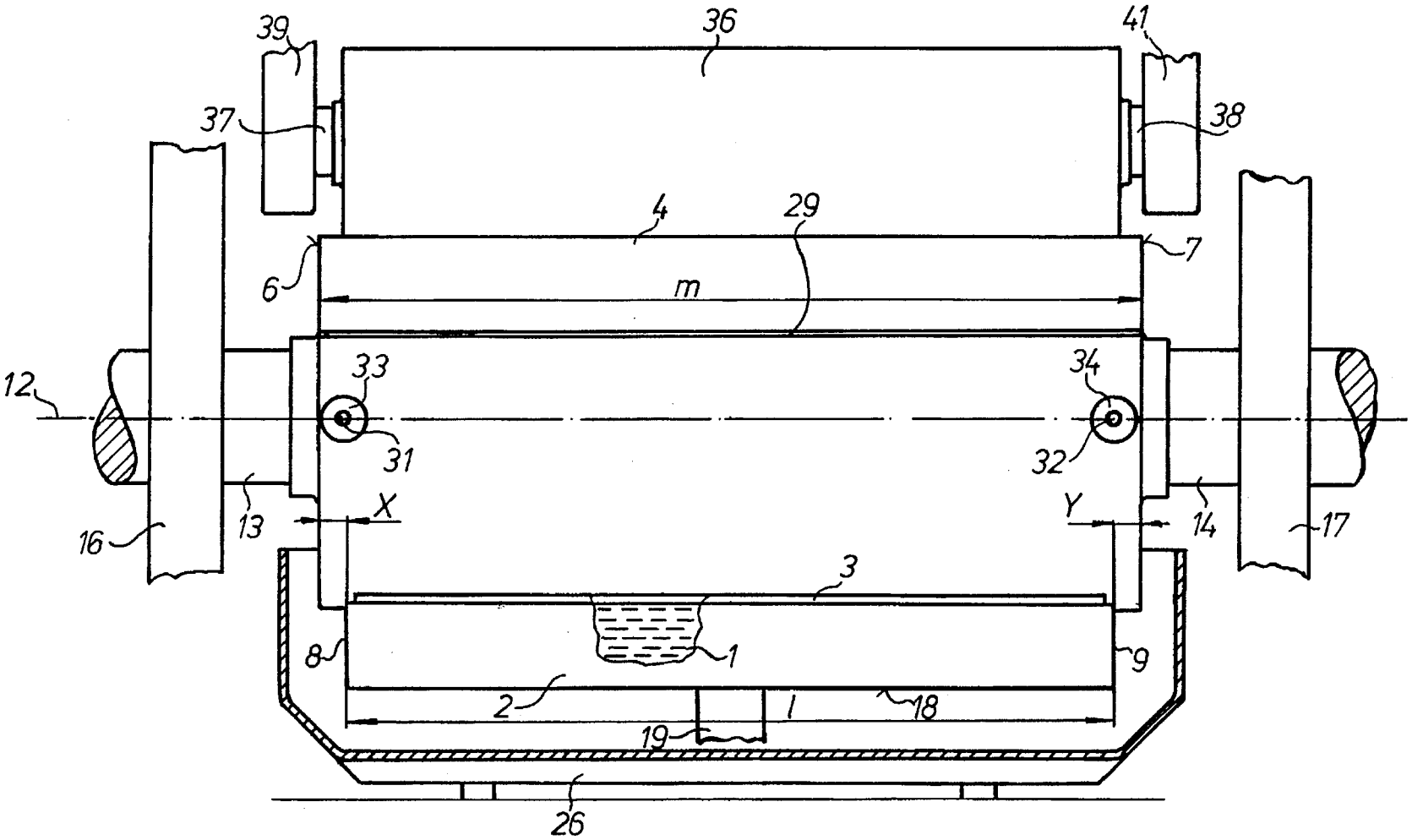
FIG. 2 is a side sectional view of the rotogravure inking system taken along lines II—II of FIG. 1.

Referring to both FIGS. 1 and 2 there may be seen a rotogravure inking system in accordance with the present invention. It will be understood that the system depicted in FIGS. 1 and 2 is a part of a larger printing press which is generally well known in structure and operation, and which forms no part of the present invention. The rotogravure inking system of the present invention is used to apply ink to a gravure cylinder which, in turn prints a web or sheet passing through the printing press.

As shown in FIGS. 1 and 2, an ink trough 2 is provided with a supply of printing ink 1, such as gravure ink. The ink trough 2 has an inking roller 3 rotatably supported in it. The ink trough 2 is filled to its brim with the printing ink 1 which is, in turn, transferred to the surface of a printing cylinder 4 that is supported for rotation about an axis of rotation 12, as shown in FIG. 1. The printing cylinder 4 has spaced axle journals 13 and 14 at its ends and these axle journals are supported for rotation in the side frames 16 and 17 of the printing press, as seen in FIG. 2. While no specific drive assembly is shown for the printing cylinder 4, it will be understood that cylinder 4 is rotatably driven from the printing press main drive in a generally well known manner.

As may be seen most clearly in FIG. 2, the ink trough 2 has a clear overall length "l". The printing cylinder 4 has a face length "m" with this face length "m" being greater than the ink trough length "l". The net effect of this is that end portions of the printing cylinder 4 overhang, or extend or project beyond the ends of the ink trough 2 by projecting distances "x" and "y". These projecting distances "x" and "y" may be equal or they may be unequal. Thus the face length "m" of the printing cylinder 4, measured in the direction of the axis of rotation 12 of the printing cylinder 4 is the clear length "l" of the ink trough 2 plus the two projecting distances "x" and "y".

The ink trough 2 is provided with end faces 8 and 9 at its axially spaced ends. Both of these end faces 8 and 9 are shown in FIG. 2 while only one end face 9 can be seen in FIG. 1. Referring to the end face 9 and understanding that the ink trough end face 8 is the same, it will be seen that each ink trough end face 8 or 9 has a recess or cut-out in its upper edge. Each such recess or cut-out has a radius of curvature "r" which is facing the jacket surface of the printing cylinder 4 and which is greater by a few millimeters than the radius "s" of the printing cylinder 4. This results in the creation of small gap 11 between the upper edges of the end walls 8 and 9 of the ink trough 2 and the surface of the printing cylinder 4.

As may be seen in FIG. 2, the ends of the printing cylinder 4 extend beyond the end face 8 and 9 of the ink trough 2 by the distances of the projections "x" and "y". This is accomplished by the provision of the cut-outs or recesses in the ink trough end faces 8 and 9. It will be understood that the lengths of these projections include the thicknesses of the end walls 8 and 9 of the ink trough 2.

The inking roller 3, which typically does not have any independent drive source, is immersed, as a function of the diameter of the printing cylinder 4, into the rotogravure printing ink 1 in the ink trough 2 with ⅚ to as much as all of its diameter. The jacket surface of the inking roller 3 is covered with a textile cover which is in frictional contact with the jacket of the printing cylinder 4. As may be seen in FIG. 1, the axis of rotation of the inking roller 3 is laterally offset a distance "b" from the axis of rotation 12 of the printing cylinder 4 and is to the left of a vertical plane passing through the axis of rotation 12 of the printing cylinder 4. This lateral offset distance "b" is approximately once or twice the diameter of the inking roller 3. As discussed above, the printing cylinder 4 is supported for rotation about its axis of rotation 12 between the press side frames 16 and 17. The rotational direction of the printing cylinder 4 is clockwise, as viewed in FIG. 1. The inking roller 3 is rotatably seated by means of a lever system fixed on the ink trough 2 and not specifically shown in the drawings. Such a support is shown in German Patent Publication DE 40 30 377 A1.

The ink trough 2 is formed having a bottom sheet metal plate 18, as may be seen in both FIGS. 1 and 2. A generally vertically oriented toothed rack 19 has an upper end which is secured to the center of the bottom sheet metal plate 8. This toothed rack 19 is vertically, slidably supported in a guide, which is not specifically shown, but which is secured to the press frame. A pinion gear 21 is in driving engagement with the teeth of the toothed rack 19. This pinion gear 21 is connected by way of a drive shaft 22 with a reduction gear to a step motor 23 and a counter 24. The counter 24 is used to indicate the actual height of the ink trough 2 and can be used as a measurement of the immersion depth of the printing cylinder 4. This counter 24 can also be used to adapt the height of the ink trough 2 to a different diameter of another printing cylinder which might be substituted for the printing cylinder 4. It is also possible to utilize two spaced toothed racks 19 which would be located spaced apart from each other and which would have a common drive. These two such spaced toothed racks 19 might be used if the length of the ink trough 2 were above a certain length.

An ink tub 26 is secured to the side frames of the press assembly, and, as may be seen most clearly in FIG. 1, is positioned generally beneath the ink trough 2. This ink tub 26 receives and collects the rotogravure printing ink 1 which exits through the gaps 11 between the end walls 8 and 9 of the ink trough 2 and the surface of the printing cylinder 4. This ink tub 26 also receives and collects any rotogravure ink 1 removed from the surface of the printing cylinder 4 by a doctor blade device, which is depicted generally at 27 in FIG. 1. The ink collected by the ink tub 26 is returned to the ink trough 2 by a suitable printing ink recirculation device, which is not specifically shown. In addition, fresh gravure printing ink 1 can be added to the ink trough 2.

Referring again to FIG. 1, the doctor blade assembly 27 is supported between the press side frames on a shaft 28 and is positioned adjacent the printing cylinder 4. The doctor blade assembly 27 can be moved on shaft 28 into contact, or out of contact with a stop 30, which can be adjusted in a horizontal plane at right angles to the axis of rotation 12 of the printing cylinder 4. The doctor blade device 27 has a pivotable head which supports a clamping arrangement, not specifically shown, for a doctor blade 29. As depicted in FIG. 1, the doctor blade 29 can be placed in engagement with the surface of the printing cylinder 4 and is usable to remove excess ink 1 from the printing cylinder 4 and to return it to the ink tub 26.

The doctor blade device 27 is provided with spaced spray nozzles 31 and 32 which are located beneath the doctor blade 29 and generally at the ends of the doctor blade device 27. These spray nozzles are thus situated adjacent the projecting portions of the printing cylinder 4 which project beyond the end walls 8 and 9 of the ink trough 2 by the projecting distances "x" and "y". Alternatively, these spray nozzles 31 and 32 could be secured to the press side frames. These spray nozzles 31 and 32 are usable to spray solvents for rotogravure printing ink 1, such as toluene, in the form of finely divided mists of spray 33 and 34 into the areas of the projecting portions "x" and "y" of the printing cylinder 4. These spray mists insure that these projecting ends of the printing cylinder 4 will not run dry. Each of the spray nozzles 31 and 32 has a supply line 35 for supplying toluene, other solvents, or compressed air to the nozzles. The doctor blade device 27 can also advantageously operate changingly because of which a more even ink distribution on the jacket of the printing cylinder 4 takes place.

A rotatable pressing roller 36, which bears against the printing cylinder 4, is located above the printing cylinder 4, as may be seen in both FIGS. 1 and 2. This pressing roller 36 is provided with axle journals B7 and 38 which are received in rockers 39 and 41 and is connected with a carriage, not specifically shown, that is joined to the side frames of the press and is adjustable in height.

In accordance with the present invention, the face length "m" of the printing cylinder 4 is preferably between two and three meters. Each of the two projections "x" and "y" may be 50 mm each, for example. The gap 11 can be up to ten millimeters wide, for example.

In operation, a paper web to be printed is passed between the inked surface of the printing roller 4 and the cooperating pressing roller 36. The ink applied to the surface of the printing cylinder 4 from the ink trough 2, and not removed by the doctor blade 29 is imparted to the paper web. Since, as has been discussed above, the ends of the printing cylinder 4 project beyond the ink trough 2 by the projecting amounts "x" and "y" and thus do not receive any printing ink 1, there will not be any printing ink which can find its way to the end faces of the printing cylinder 4. Thus there is no excess printing ink 1 which will be thrown off the printing cylinder 4 in the form of ink spatters. Accordingly, the rotogravure inking system of the present invention overcomes the problems of the prior art devices and provides a much cleaner inking system.

While a preferred embodiment of a rotogravure inking system in accordance with the present invention has been set forth fully and completely hereinabove, it will be apparent to one of skill in the art that a number of changes in, for example the overall size of the inking cylinder, the drive assembly for the cylinder, the type of doctor blade used, and the like may be made without departing from the true spirit and scope of the present invention which is accordingly to be limited only by the following claims.

What is claimed is:

1. A rotogravure inking system for a rotary printing press, said system comprising:

an ink trough adapted to receive a supply of printing ink, said ink trough having a clear overall length;

an ink roller disposed within said ink trough;

a printing cylinder supported for rotation above said ink trough about an axis of rotation and having a jacket surface with a face length and first and second end faces, a portion of said face length of said jacket surface being immersible in said ink in said ink trough, said printing cylinder having a radius of curvature, said face length of said printing cylinder being greater than said clear overall length of said ink trough;

spaced first and second ink trough end faces forming end walls of said ink trough, each of said ink trough end faces having an upper edge;

a recess formed in said upper edge of each of said first and second ink trough end faces, each said ink trough end face recess having a curvature matched to said radius of curvature of said printing cylinder, said jacket surface of said printing cylinder and each of said recesses defining a gap between said ink trough end faces and said printing cylinder, said printing cylinder having first and second end portions extending beyond said first and second ink trough end faces by first and second projecting distances, jacket surfaces of said first and second printing cylinder end portions which extend beyond said ink trough not being immersible in said ink in said ink trough; and spray nozzles directed toward said first and second projecting end portions of said printing cylinder and being usable to spray said projecting end portions with a solvent for said printing ink.

2. The rotogravure inking system of claim 1 wherein said first and second projecting distances are of equal lenghts.

3. The rotogravure inking system of claim 1 wherein said first and second projecting distances are of unequal lengths.

4. The rotogravure inking system of claim 1 wherein said solvent is toluene.

* * * * *